US009322298B2

(12) United States Patent
Graeber et al.

(10) Patent No.: US 9,322,298 B2
(45) Date of Patent: Apr. 26, 2016

(54) STEAM TURBINE INSTALLATION AND METHOD FOR OPERATING THE STEAM TURBINE INSTALLATION

(75) Inventors: Carsten Graeber, Erlangen (DE); Thomas Loeper, Erlangen (DE); Michael Wechsung, Mülheim an der Ruhr (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 116 days.

(21) Appl. No.: 14/131,499

(22) PCT Filed: Jun. 14, 2012

(86) PCT No.: PCT/EP2012/061251

§ 371 (c)(1),
(2), (4) Date: Jan. 20, 2014

(87) PCT Pub. No.: WO2013/007462

PCT Pub. Date: Jan. 17, 2013

(65) Prior Publication Data

US 2014/0130499 A1 May 15, 2014

(30) Foreign Application Priority Data

Jul. 14, 2011 (EP) ..... 11174006

(51) Int. Cl.

| | |
|---|---|
| ***F01K 7/34*** | (2006.01) |
| ***F01K 7/38*** | (2006.01) |
| ***F01K 7/40*** | (2006.01) |
| ***F22D 1/32*** | (2006.01) |

(Continued)

(52) U.S. Cl.
CPC ... *F01K 7/44* (2013.01); *F01K 7/34* (2013.01); *F01K 7/40* (2013.01); *F01K 13/02* (2013.01); *F22D 1/32* (2013.01); *F22D 1/325* (2013.01)

(58) Field of Classification Search
CPC ..... F01K 7/34; F01K 7/40; F01K 7/44; F01K 13/02; F22D 1/32; F22D 1/325
See application file for complete search history.

(56) References Cited

U.S. PATENT DOCUMENTS

| | | | | |
|---|---|---|---|---|
| 3,291,105 | A * | 12/1966 | Stenard | 122/406.1 |
| 6,572,328 | B2 | 6/2003 | Tremmel et al. | |
| 6,964,167 | B2 | 11/2005 | Abel et al. | |

(Continued)

FOREIGN PATENT DOCUMENTS

| | | | |
|---|---|---|---|
| CN | 201661320 | U | 12/2010 |
| DE | 4447044 | C1 | 4/1996 |
| DE | 10042317 | A1 | 3/2002 |
| EP | 1241323 | A1 | 9/2002 |

(Continued)

*Primary Examiner* — Audrey K Bradley
(74) *Attorney, Agent, or Firm* — Beusse Wolter Sanks & Maire

(57) ABSTRACT

A steam turbine installation that has a steam turbine, a steam generator and a feed water pre-heating unit operated by process steam is provided. The steam turbine has an overload bypass line with which main steam can be fed to the feed water pre-heating unit between the steam turbine input and the extraction point during overload operation of the steam turbine, wherein the feed water pre-heating unit has an auxiliary extraction line that is connected to the overload bypass line in such a way that process steam can be extracted from the steam turbine during partial load operation of the steam turbine and added to the feed water pre-heating unit for the additional pre-heating of feed water.

15 Claims, 1 Drawing Sheet

(51) Int. Cl.
*F01K 7/44* (2006.01)
*F01K 13/02* (2006.01)

(56) References Cited

U.S. PATENT DOCUMENTS

| | | | | |
|---|---|---|---|---|
| 2012/0174584 | A1 | 7/2012 | Gobrecht | |
| 2012/0272649 | A1 * | 11/2012 | Berndt et al. | 60/645 |

FOREIGN PATENT DOCUMENTS

| | | | | |
|---|---|---|---|---|
| EP | 2299068 | A1 | 3/2011 | |
| JP | 59110811 | A | 6/1984 | |
| JP | H02149704 | A | 6/1990 | |
| JP | H04358707 | A | 12/1992 | |
| JP | 7083006 | A | 3/1995 | |
| NL | 6817712 | A | 3/1970 | |
| WO | WO 2011015185 | A2 * | 2/2011 | F01K 13/00 |

* cited by examiner

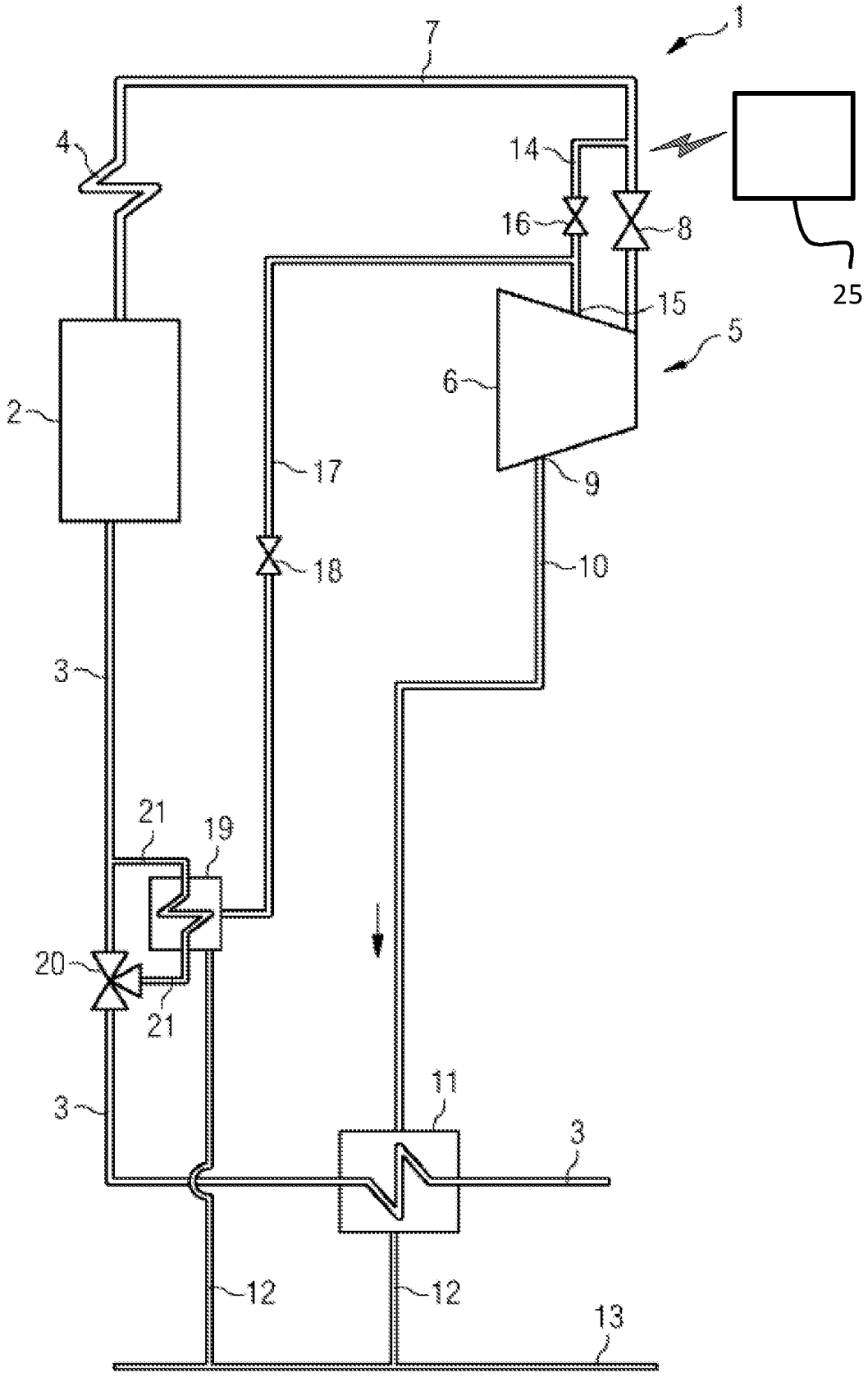
1
7
4
14
16
8
25
15
5
6
2
17
9
18
10
3
21
19
20
21
3
11
3
12
12
13

STEAM TURBINE INSTALLATION AND METHOD FOR OPERATING THE STEAM TURBINE INSTALLATION

CROSS REFERENCE TO RELATED APPLICATIONS

This application is the US National Stage of International Application No. PCT/EP2012/061251 filed Jun. 14, 2012, and claims the benefit thereof. The International Application claims the benefit of European Application No. EP11174006 filed Jul. 14, 2011. All of the applications are incorporated by reference herein in their entirety.

FIELD OF INVENTION

The invention relates to a steam turbine installation and to a method for operating the steam turbine installation.

BACKGROUND OF INVENTION

A steam turbine installation is in particular used in a thermal power plant for generating electrical energy. It is desirable, in particular for ecological and economic reasons, for the steam turbine installation to be operated at as high a thermal efficiency as possible. It is conventional for the steam turbine installation to have a steam turbine and a steam generator which heats feed water and thus produces live steam which is made available to the steam turbine for driving same. This cyclic process of the steam turbine installation is configured, as is conventional, such that it is at maximum thermal efficiency when the steam turbine is under full load. Other operating states, below full load, lead to correspondingly lower thermal efficiencies.

However, partial-load operation of the steam turbine installation, especially when the latter is used in the power plant, is highly relevant as, for example in the case of the steam turbine installation, a power reserve must be maintained in order to cope with overload operation states. It is thus desirable to operate the steam turbine installation over a broad load range with a thermal efficiency that is as high as possible.

SUMMARY OF INVENTION

An object herein is to specify a steam turbine installation and a method for operating the steam turbine installation, wherein the steam turbine installation has a high thermal efficiency over a broad power range.

The steam turbine installation herein has a steam turbine, a steam generator and a feed water pre-heating device which is operated using process steam, wherein the steam turbine has an overload bypass line by means of which, in overload operation of the steam turbine, live steam can be fed in between the steam turbine inlet and the bleed point of the feed water pre-heating device, wherein the feed water pre-heating device has an auxiliary bleed line which is connected to the overload bypass line such that, in partial-load operation of the steam turbine, process steam can be bled from said steam turbine and can be fed to the feed water pre-heating device to provide auxiliary pre-heating of the feed water. The method according to the invention for operating the steam turbine installation has the following steps: determining the optimum efficiency and the associated rated power of the steam turbine; as soon as the steam turbine is operated above the rated power, opening the overload bypass line and isolating the auxiliary bleed line such that live steam is fed in between the steam turbine inlet of the steam turbine and the bleed point of the feed water pre-heating device; as soon as the steam turbine is operated below the rated power, isolating the overload bypass line and opening the auxiliary bleed line such that process steam is bled from between the steam turbine inlet of the steam turbine and the bleed point and is fed to the feed water pre-heating device to provide auxiliary pre-heating of the feed water.

The overload bypass line is thus provided for overload operation of the steam turbine and the auxiliary bleed line is provided for partial-load operation of the steam turbine. In overload operation of the steam turbine, a partial mass flow of live steam is guided around a first part of the high-pressure blading of the steam turbine and is fed into the steam turbine. The steam turbine can thus produce the extra power above the rated power without the live steam pressure at the steam turbine inlet having to be raised with respect to the rated load operating state.

Furthermore, operating the auxiliary bleed line in partial-load operation of the steam turbine causes process steam to be bled from the steam turbine, which process steam is fed to the feed water pre-heating device to provide auxiliary pre-heating of the feed water in partial-load operation of the steam turbine, whereby the temperature of the feed water is raised. The thermodynamically-induced reduction in feed water temperature when the power of the steam turbine decreases can thus be countered. Given that the drop in temperature of the feed water would cause the thermal efficiency of the steam turbine installation to drop, use of the auxiliary bleed line in partial-load operation of the steam turbine means that the thermal efficiency of the steam turbine is high. Thermal efficiency is thus high in both overload operation and partial-load operation of the steam turbine, such that the thermal efficiency of the steam turbine is high over a broad power range thereof.

Given that the auxiliary bleed line is connected to the overload bypass line, the point at which both the overload bypass line and the auxiliary bleed line open into the steam turbine is the same point as that provided for feeding in the live steam in the event of an overload and for bleeding the process steam in the event of a partial load. The steam turbine thus has just a single point at which both the overload bypass line and the auxiliary bleed line are built on. Were this not the case, providing two or more points for feeding in live steam in the event of an overload and bleeding the process steam in the event of partial load would be difficult in terms of construction and could be carried out only at great expense, such that the steam turbine installation according to the invention with its single connection point for the overload bypass line and the auxiliary bleed line is constructed simply and cost-effectively.

The steam turbine installation is advantageously designed with a control system. Providing the overload bypass line and the auxiliary bleed line advantageously achieves a leveling of the efficiency profile as a function of the power of the steam turbine. This allows changes in the load on the steam turbine installation to be managed more quickly while maintaining a constant, high level of thermal efficiency. Furthermore, the load range in which the steam turbine installation can be operated in the case of a constant temperature of the live steam produced by the steam generator is large. It is also advantageously achieved that the steam turbine installation has a minimum operation point at low partial load at which the steam turbine can still be operated with stable conditions in the steam turbine installation (Benson minimum load).

In the method for operating the steam turbine installation, it is preferred that, when the steam turbine is in an operating state below the rated power, the auxiliary pre-heating of the feed water is provided such that the temperature of the feed water at the feed water inlet of the steam generator is constant over the load. A preferred alternative is that, when the steam turbine is in an operating state below the rated power, the auxiliary pre-heating of the feed water is provided such that the temperature of the feed water at the feed water inlet of the steam generator increases when the power of the steam turbine installation decreases. It is further preferred that, by increasing the temperature of the feed water at the feed water inlet of the steam generator while at the same time increasing the amount of feed water at the feed water inlet of the steam generator, the minimum operating point of the steam turbine installation can be shifted to lower partial loads. The feed water temperature can advantageously be increased up to the thermal and mechanical load limits of the steam generator. Any flue gas process steps connected downstream of the steam turbine installation, such as a DeNOx installation, can operate at a higher flue gas temperature as a consequence of the raised feed water temperature.

This feed water pre-heating device preferably has a feed water pre-heater which is operated using the process steam bled from the bleed point and using the process steam bled using the auxiliary bleed line. Thus, both the process steam bled using the auxiliary bleed line and the process steam bled from the bleed point are supplied for operating the feed water pre-heater.

Alternatively, the feed water pre-heating device has a feed water pre-heater which is operated using the process steam bled from the bleed point, and has an auxiliary pre-heater which is operated using the process steam bled using the auxiliary bleed line. As the auxiliary pre-heater is provided in the steam turbine installation, integrating the auxiliary pre-heater into the cyclic process of the steam turbine installation can be done independently of the integration of the feed water pre-heater, such that degrees of freedom can advantageously be used for optimizing the thermal efficiency of the steam turbine installation. It is preferred in this context that the auxiliary pre-heater is connected downstream of the feed water pre-heater in the feed water flow. The auxiliary pre-heater is thus advantageously connected downstream of the feed water pre-heater. This is advantageous in particular because the pressure of the process steam with which the auxiliary pre-heater is operated is higher than the pressure of the process steam with which the feed water pre-heater is operated.

It is also preferred that the feed water pre-heating device has a three-way valve by means of which the auxiliary pre-heater can be connected to—and disconnected from—the feed water flow. In this case, by means of the three-way valve, part of the feed water flow can preferably be guided through the auxiliary pre-heater. Advantageously, therefore, using the three-way valve, the entire feed water flow can either be guided past the auxiliary pre-heater, for example in overload operation of the steam turbine, or can be guided in part or in full through the auxiliary pre-heater, for example in partial-load operation of the steam turbine. Thus, with respect to optimizing the thermal efficiency of the steam turbine installation, optimization can be achieved in every operating state by corresponding actuation of the three-way valve and corresponding regulation of the part of the feed water flow flowing through the auxiliary pre-heater.

An auxiliary bleed valve is preferably integrated into the auxiliary bleed line, allowing the mass flow of the process steam in the auxiliary bleed line to be controlled. It is also preferred that the steam turbine is a high-pressure steam turbine.

BRIEF DESCRIPTION OF THE DRAWINGS

A preferred embodiment of the steam turbine installation of the invention is described below with reference to the appended schematic drawing.

The FIGURE shows a heat-flow diagram of the embodiment of the steam turbine installation.

DETAILED DESCRIPTION OF INVENTION

As the FIGURE shows, a steam turbine installation 1 has a steam generator 2 which is provided for producing live steam in the steam turbine installation 1. The steam turbine installation 1 also has a feed water feed line 3 by means of which feed water is fed to the steam generator 2. Downstream of the steam generator 2 is a superheater 4 which prepares the live steam in a supercritical state.

The steam turbine installation 1 also has a steam turbine 5 which is designed as a high-pressure stage 6 and at the inlet of which the live steam can be caused to flow in via a live steam line 7 in order to drive the steam turbine 5. The mass flow of the live steam can be controlled using a live steam valve 8 installed in the live steam line 7. In the steam turbine 5, the live steam can be expanded as process steam, whereby the shaft power of the steam turbine 5 can be obtained.

The steam turbine 5 has a bleed pipe 9 which opens into a bleed line 10 which leads to a feed water pre-heater 11. The bleed pipe 9 allows process steam to be tapped from the steam turbine 5, which steam is fed via the bleed line 10 to the feed water pre-heater 11. The feed water pre-heater 11 is embodied as a heat exchanger which is connected into the feed water feed line 3 such that the feed water can be pre-heated by condensing the process steam in the feed water pre-heater 11. The condensate produced by condensing the process steam can be carried off via a condensate line 12 to a condensate collection line 13.

The steam turbine 5 has an overload bypass line 14 which branches off from the live steam line 7 upstream of the live steam valve 8 and leads to an overload bypass pipe 15 of the steam turbine 5 which is arranged between the live steam inlet and the bleed pipe 9. An overload bypass valve 16, allowing the live steam mass flow through the overload bypass line 14 to be controlled and the overload bypass line 14 to be isolated, is provided in the overload bypass line 14.

Downstream of the overload bypass valve 16, the overload bypass line 14 opens into an auxiliary bleed line 17 leading to an auxiliary pre-heater 19. An auxiliary bleed valve 18, allowing the process steam mass flow through the auxiliary bleed line 17 to be controlled and the auxiliary bleed line 17 to be isolated, is installed in the auxiliary bleed line 17.

The auxiliary pre-heater 19 is designed as a heat exchanger through which both the process steam from the auxiliary bleed line 17 and the feed water from the feed water feed line 3 can flow. The auxiliary pre-heater 19 is arranged downstream of the feed water pre-heater 11 such that feed water which has already been pre-heated by the feed water pre-heater 11 can flow through the auxiliary pre-heater 19. The auxiliary pre-heater 19 is connected in parallel with the feed water feed line 3 via a feed water pre-heating line 21. At the upstream junction of the feed water pre-heating line 21 and of the feed water feed line 3, there is installed a three-way valve 20 by means of which it is possible to control the feed water flow in the feed water feed line 3 which can be made to flow through the auxiliary pre-heater 19. The three-way valve 20 is thus to be appropriately switched either if no feed water, the entire feed water flow or only a part thereof is to be channeled through the auxiliary pre-heater 19.

The thermal efficiency of the steam turbine 5 varies over its power range depending on its configuration and construction. The steam turbine 5 is configured such that it should have maximum thermal efficiency at a predefined rated power. A control system 25 is provided to determine the maximum thermal efficiency and the rated power of the steam turbine 5. If the steam turbine operates above the rated power, the overload bypass valve 16 is opened by the control system 25 and the auxiliary bleed valve 18 is closed by the control system 25, whereby the overload bypass line 14 is opened and the auxiliary bleed line 17 is isolated. Live steam is thereby fed in between the inlet of the steam turbine 5 and the bleed point 9. As soon as the steam turbine 5 is operating below the rated power, the overload bypass valve 16 is closed by the control system 25 so that the overload bypass line 14 is isolated, and the auxiliary bleed valve 18 is opened by the control system 25 so that the auxiliary bleed line 17 is opened. Process steam is thereby bled from the steam turbine 5 upstream of the bleed pipe 9, this steam being fed to the auxiliary pre-heater 19. A corresponding setting of the auxiliary bleed valve 18 allows the mass flow of process steam in the auxiliary bleed line 17 to be controlled. The process steam flows from the auxiliary bleed line 17 to the auxiliary pre-heater 19 and is condensed, giving off heat. The resulting condensate is fed by the condensate line 12 to the condensate collection line 13.

The three-way valve 20 is to be actuated accordingly depending on the pressure of the process steam at the inlet to the auxiliary pre-heater 19 and on the resulting pre-heating of the feed water at the outlet of the auxiliary pre-heater 19 into the feed water pre-heating line 21, or the resulting mixing of the feed water in the downstream section of the feed water feed line 3.

The invention claimed is:

1. A steam turbine installation comprising:

a steam turbine, a steam generator and a feed water pre-heating device which is operated using process steam, the steam turbine comprising an overload bypass line which, in overload operation of the steam turbine, live steam can be fed in between a steam turbine inlet and a bleed point of the feed water pre-heating device, and the feed water pre-heating device comprising an auxiliary bleed line which is connected to the overload bypass line such that, in partial-load operation of the steam turbine, process steam can be bled from said steam turbine and can be fed to the feed water pre-heating device to provide auxiliary pre-heating of the feed water, and a control system adapted to determine an optimum efficiency and an associated rated power of the steam turbine;

open the overload bypass line and isolate the auxiliary bleed line in response to determining that the steam turbine is operated above the associated rated power such that live steam is fed in between the steam turbine inlet of the steam turbine and the bleed point of the feed water pre-heating device; and isolate the overload bypass line and open the auxiliary bleed line in response to determining that the steam turbine is operated below the associated rated power such that process steam is bled from between the steam turbine inlet of the steam turbine and the bleed point and is fed to the feed water pre-heating device to provide auxiliary pre-heating of the feed water.

2. The steam turbine installation as claimed in claim 1, wherein the feed water pre-heating device is operated using the process steam bled from the bleed point and using the process steam bled using the auxiliary bleed line.

3. The steam turbine installation as claimed in claim 1, further comprising an auxiliary bleed valve integrated into the auxiliary bleed line, allowing a mass flow of the process steam in the auxiliary bleed line to be controlled.

4. The steam turbine installation as claimed in claim 1, wherein the steam turbine is a high-pressure steam turbine.

5. The steam turbine installation as claimed in claim 1, wherein the auxiliary bleed line is connected to the overload bypass line upstream of the steam turbine and downstream of the steam generator.

6. The steam turbine installation as claimed in claim 1, wherein the feed water pre-heating device has a feed water pre-heater which is operated using the process steam bled from the bleed point, and an auxiliary pre-heater which is operated using the process steam bled using the auxiliary bleed line.

7. The steam turbine installation as claimed in claim 6, wherein the auxiliary pre-heater is connected downstream of the feed water pre-heater in a feed water flow.

8. The steam turbine installation as claimed in claim 6, further comprising a three-way valve configured to connect and disconnect the auxiliary pre-heater from a feed water flow.

9. The steam turbine installation as claimed in claim 8, wherein the three-way valve is further configured to guide part of the feed water flow through the auxiliary pre-heater.

10. A method for operating a steam turbine installation comprising a steam turbine, a steam generator and a feed water pre-heating device which is operated using process steam, the steam turbine comprising an overload bypass line which, in overload operation of the steam turbine, live steam is adapted to be fed in between a steam turbine inlet and a bleed point of the feed water pre-heating device, and the feed water pre-heating device comprising an auxiliary bleed line which is connected to the overload bypass line such that, in partial-load operation of the steam turbine, process steam is adapted to be bled from said steam turbine and be fed to the feed water pre-heating device to provide auxiliary pre-heating of the feed water, and a control system, the method comprising:

determining an optimum efficiency and an associated rated power of the steam turbine;

opening the overload bypass line and isolating the auxiliary bleed line in response to determining that the steam turbine is operated above the associated rated power, such that live steam is fed in between the steam turbine inlet of the steam turbine and the bleed point of the feed water pre-heating device; and isolating the overload bypass line and opening the auxiliary bleed line in response to determining that the steam turbine is operated below the associated rated power, such that process steam is bled from between the steam turbine inlet of the steam turbine and the bleed point and is fed to the feed water pre-heating device to provide auxiliary pre-heating of feed water.

11. The method as claimed in claim 10, further comprising in response to the steam turbine operating below the rated power, providing the auxiliary pre-heating of the feed water such that the temperature of the feed water at the feed water inlet of the steam generator increases when the power of the steam turbine installation decreases.

12. The method as claimed in claim 10, wherein live steam is fed into the steam turbine to drive the steam turbine when the steam turbine is operated above the rated power.

13. The method as claimed in claim 10, wherein when the steam turbine is operated below the rated power, the process steam is bled from the inlet of the steam turbine through a junction of the overload bypass line and the auxiliary bleed line and directed through the auxiliary bleed line to an auxiliary pre-heater of the feed water pre-heating device.

14. The method as claimed in claim 10, further comprising in response to the steam turbine operating below the rated power, providing the auxiliary pre-heating of the feed water such that the temperature of the feed water at the feed water inlet of the steam generator is constant over a load.

15. The method as claimed in claim 14, further comprising increasing the temperature of the feed water at the feed water inlet of the steam generator while at the same time increasing the amount of feed water at the feed water inlet of the steam generator, such that a minimum operating point of the steam turbine installation can be shifted to lower partial loads.

* * * * *